US010046963B2

(12) United States Patent
Smith

(10) Patent No.: US 10,046,963 B2
(45) Date of Patent: Aug. 14, 2018

(54) SPLIT REINS CONNECTOR ASSEMBLY AND METHOD

(71) Applicant: Kelly Dean Smith, Fairfield, IL (US)

(72) Inventor: Kelly Dean Smith, Fairfield, IL (US)

( * ) Notice: Subject to any disclaimer, the term of this patent is extended or adjusted under 35 U.S.C. 154(b) by 318 days.

(21) Appl. No.: 15/151,172

(22) Filed: May 10, 2016

(65) Prior Publication Data

US 2016/0332862 A1 Nov. 17, 2016

Related U.S. Application Data

(60) Provisional application No. 62/159,693, filed on May 11, 2015.

(51) Int. Cl.

| | |
|---|---|
| ***B68B 5/00*** | (2006.01) |
| ***A44B 17/00*** | (2006.01) |
| ***A44B 11/04*** | (2006.01) |
| ***B68B 5/02*** | (2006.01) |

(52) U.S. Cl.

CPC ..... *B68B 5/02* (2013.01); *A44B 11/04* (2013.01); *B68B 5/00* (2013.01); *A44B 17/0041* (2013.01)

(58) Field of Classification Search

CPC ..... A44B 11/00; A44B 11/006; A44B 11/02; A44B 11/04; A44B 11/18; A44B 11/25; A44B 11/258; A44B 17/00; A44B 17/0005; A44B 17/0041; A44B 17/0064; B68B 5/00; B68B 5/02; B68B 9/00; B68B 99/00; Y10T 24/4002

USPC ..... 24/164, 172, 182; 54/64, 74, 1, 16–17

See application file for complete search history.

(56) References Cited

U.S. PATENT DOCUMENTS

| | | | | | |
|---|---|---|---|---|---|
| 742,921 | A * | 11/1903 | Smith | B68B 5/00 | 24/164 |
| 1,828,256 | A * | 10/1931 | Reiter | A44B 17/0005 | 24/324 |
| 1,904,055 | A * | 4/1933 | King | A44B 17/0005 | 24/324 |
| 2,486,652 | A * | 11/1949 | Huelster | A44B 11/006 | 24/324 |
| 2,800,697 | A * | 7/1957 | Carpinella | A44B 17/0005 | 24/324 |
| 3,045,304 | A * | 7/1962 | Shears | A44B 11/006 | 24/324 |
| 6,457,774 | B2 * | 10/2002 | Baloga | B60N 2/2812 | 297/250.1 |
| 6,662,413 | B2 * | 12/2003 | Glover | A44B 11/2511 | 24/614 |
| 8,827,766 | B2 * | 9/2014 | Lin | A41F 1/006 | 2/326 |

(Continued)

*Primary Examiner* — Jack W Lavinder

(74) *Attorney, Agent, or Firm* — Gary K. Price

(57) ABSTRACT

A connector assembly used with split reins and configured to directly attach with the split reins. The connector assembly includes first and second connecting members, each of the connecting members include a pair of spaced end bars and a center bar that define a first and second spacing, and a pair of side bars having a semi-U shaped configuration. A raised member upwardly extends from a top side of the center bar, and a fastener is attached to a lower side of the center bar. One connecting member having a male fastener half, and one connecting member having a female fastener half, such that the rider releasably attaches one connecting member on the first rein to the one connecting member on the second rein by attaching the male and female fastener halves.

10 Claims, 10 Drawing Sheets

(56) References Cited

U.S. PATENT DOCUMENTS

| | | | | |
|---|---|---|---|---|
| 9,314,088 | B2 * | 4/2016 | Lesch | A44B 11/2573 |
| 9,877,570 | B2 * | 1/2018 | Bergkvist | A45F 3/04 |
| 2002/0148081 | A1 * | 10/2002 | Ide | A44B 11/04 24/324 |
| 2006/0242803 | A1 * | 11/2006 | Drake | A44B 11/04 24/324 |

* cited by examiner

SPLIT REINS CONNECTOR ASSEMBLY AND METHOD

CROSS REFERENCES TO RELATED APPLICATIONS

U.S. Provisional Application for Patent No. 62/159,693, filed May 11, 2015, with title "Split Reins Connector Assembly and Method" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates generally to methods and apparatus directed to improving the handling and riding of horses, and more particularly to a unique connector device adapted for use with split reins. The invention described mitigates the undesirable practice of knotting the two (split) reins together to keep them from falling to the ground, thereby providing an advantage in the management of split reins during application.

2. Brief Description of Prior Art

A great amount of attention and creative effort has been expended over the years for the purpose of providing improved methods and apparatus for controlling horse handling and performance during the wide range of activities horses and riders engage in. These efforts have produced a myriad of devices and techniques, all of which contribute in some degree to improved performance from rider and horse.

There are two basic styles of Western reins: split reins which are two separate reins, and the romal rein, which is one continuous rein forming a loop. Many horse-riders who use split reins have some concern with managing each rein during application in order to avoid one or both of the reins from falling to the ground. Most horse-riders who use split reins will tie a simple overhand knot by laying both reins side by side and making a loop that feeds both ends back to just past where the hand grip would be. For many horse-riders, tying a knot in the reins as described is undesirable. The knot is not only unsightly, but also requires the additional step of later untying the reins during use. In addition, tying the reins as described often leaves creases, especially when the reins are newer or stiffer and may therefore not tie very easily without the need for additional oiling and breaking in.

In view of the foregoing, there is still a need for an effective alternative to the practice of riding horseback using split reins. In particular, there is a need for an alternative to the practice of knotting the split reins. The present invention is intended to address this general concern.

SUMMARY OF THE INVENTION

The present invention provides a connector device that is used with split reins and configured to directly attach with the split reins. The connector device includes a pair of connecting members, each connecting member having a pair of spaced end bars and a center bar that define a first and second spacing therebetween. Each connecting member further defines a pair of side bars having a semi-U shaped configuration. A raised member upwardly extends from a top side of the center bar, and a fastener is attached to a lower side of the center bar.

One connecting member having a male fastener portion is attached with a first rein, and one connector having a female fastener portion is attached with a second rein. The rider releasably attaches the connecting member on the first rein to the connecting member on the second rein by attaching the male and female fastener portions.

In application, an end of one of the split reins is passed through the first spacing, positioned over the upwardly extending pin member, and passed through the second spacing. The connector device can be slidably positioned along the length of the rein for application.

DESCRIPTION OF THE PREFERRED EMBODIMENT

The present invention is directed to a connector assembly for use by horse-riders who use split reins, and is used in application as an alternative to the common practice of tying a knot in the two reins for example, when the horse is tied (using a lead rope) to a post or other suitable object to tie a horse, in order to avoid the reins from falling to the ground. The present invention generally discloses a pair of connectors that manage the reins and will prevent the reins from falling. In the broadest context, the connector assembly as disclosed consists of components configured and correlated with respect to each other so as to attain the desired objective.

Figure 9:
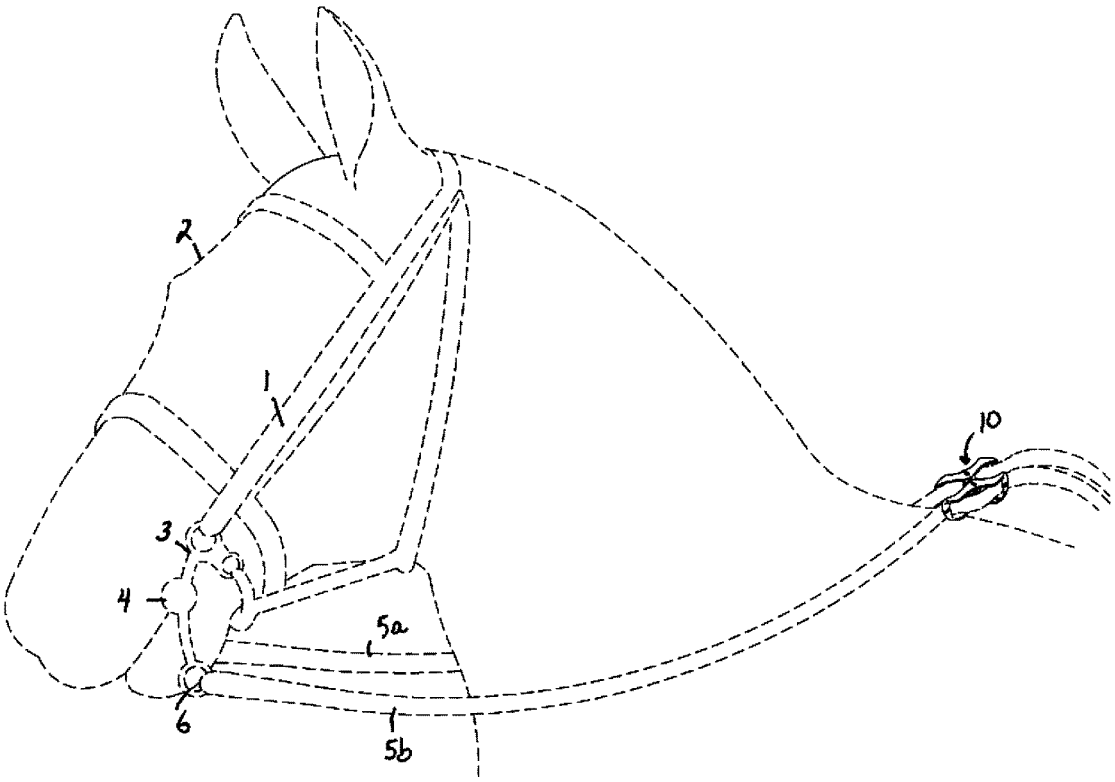
FIG. 9 is an illustration of a tack arrangement including the present invention for use when riding a horse.

Referring to FIG. 9, a bridle 1 is often used to assist the rider in controlling the animal and causing it to move in the desired direction. The bridle 1 generally includes straps which adjustably fit around the animal's head 2, a metal bit 3 including a mouthpiece 4 adapted to fit in the animal's mouth and extend over and atop its tongue, and a set of reins 5*a*, 5*b* which are conventionally attached to end rings 6 of the bit 3 at either side of the animal's mouth. With split reins, there is two distinct separate pieces of rein that connect to the bit on one end 5*a*, and the opposite end 5*b* the rider maintains in its hands in the box above and forward of the saddle horn. When the horse is, for example, tied to a post with a lead rope, it is very common for the rider to tie a simple overhand knot in the ends 5*b* of the reins in order to avoid the reins from falling to the ground.

The present invention provides a connector that is used with split reins and configured to directly attach with the split reins.

The connector device, designated as numeral 10, is defined by two (2) connecting members designated as numerals 21 and 23. Referring to FIGS. 1-8, there are illustrated various views of the exemplary connector device 10. Each of the connecting members 21 and 23 are identically constructed having the same embodiments. As such, only the elements of the connecting member 21 will be described below, it being understood that the connecting member 23 as illustrated in the drawings is a mirror image of connecting member 21 being described.

Connecting member 21 includes a pair of spaced end bars 15 and a center bar 18 joined together by side bars 20. The side bars 20 having a semi-U shaped configuration that define an inward side 28 and an outward side 29 such that a raised member 22 (as will be discussed) is disposed on the outward side 29 and connecting halves 25, 26 as will be described, is disposed on the inward side 28. The center bar 18 further includes a central aperture 18*c*.

As illustrated, the raised member 22 extends from a first side 18*a* of the center bar 18. As will be described, a fastener is attached to a second side 18*b* of the center bar 18. As illustrated, the spaced end bars 15 and center bar define a first spacing 30 and a second spacing 31.

As illustrated, the side bars 20 are parallel to one another, and the end bars 15 and center bar are parallel to one another but perpendicular to the side bars 20. Further, referring to FIG. 3, side bars 20 define a length L and end bars 15 define a width W where the length L is greater than the width W.

Figure 1:
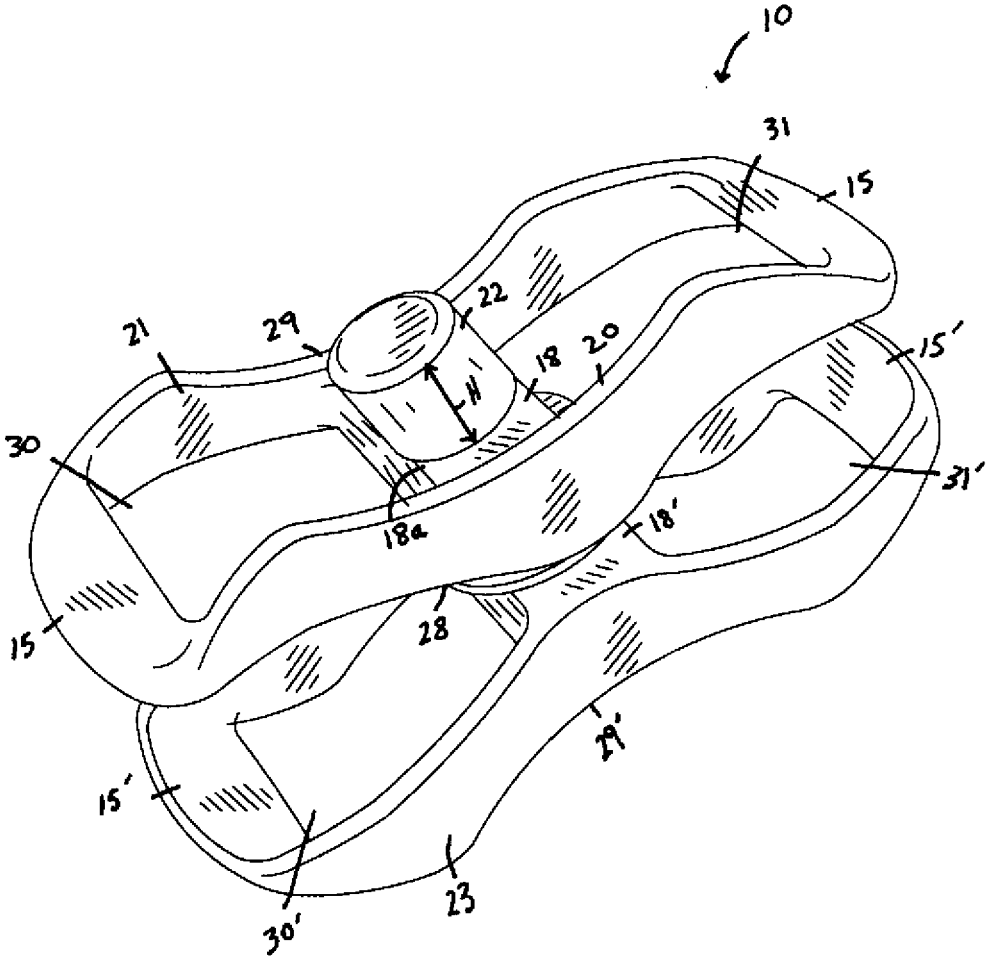
FIG. 1 is a perspective view of the preferred embodiment of the present invention, a split reins connector assembly.
Figure 2:
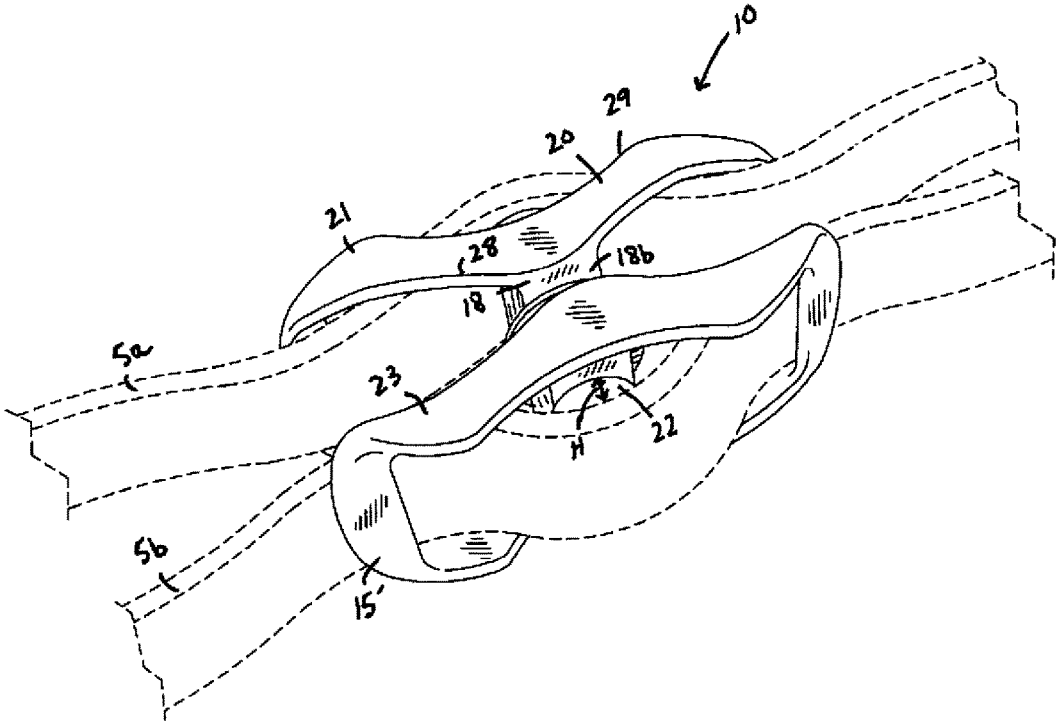
FIG. 2 is a perspective view illustrating the split reins connector assembly with two reins shown in broken lines and not part of the present invention.
Figure 3:
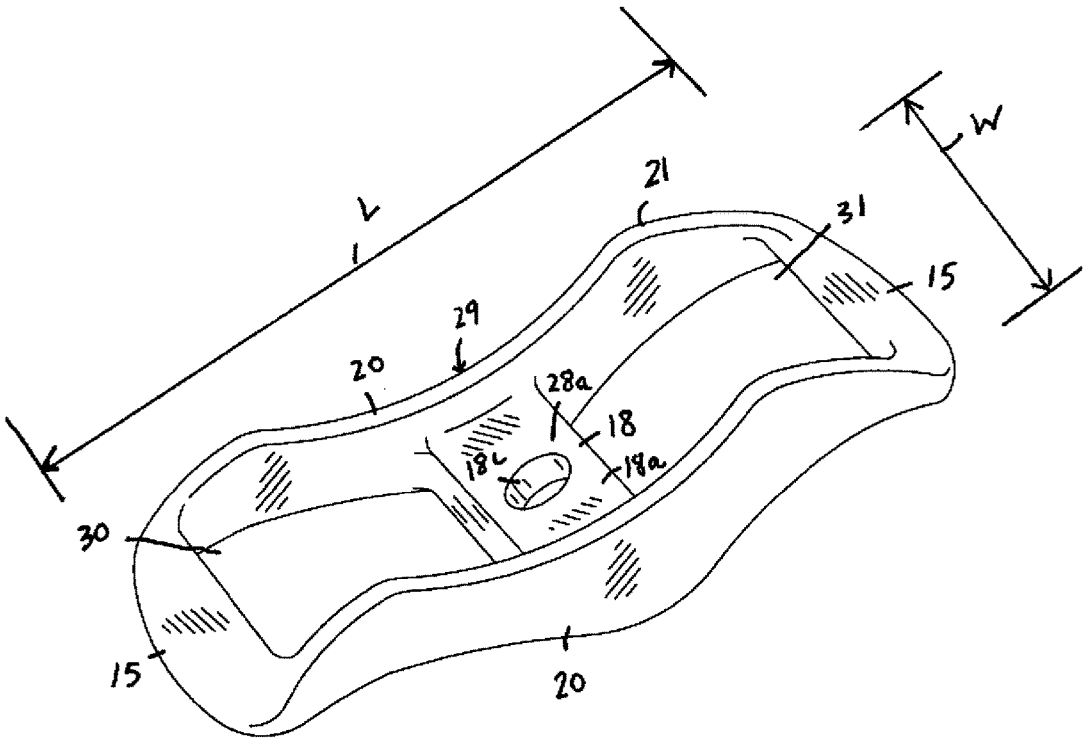
FIG. 3 is a perspective view of the inward side of one of the connecting members of the present invention.
Figure 4:
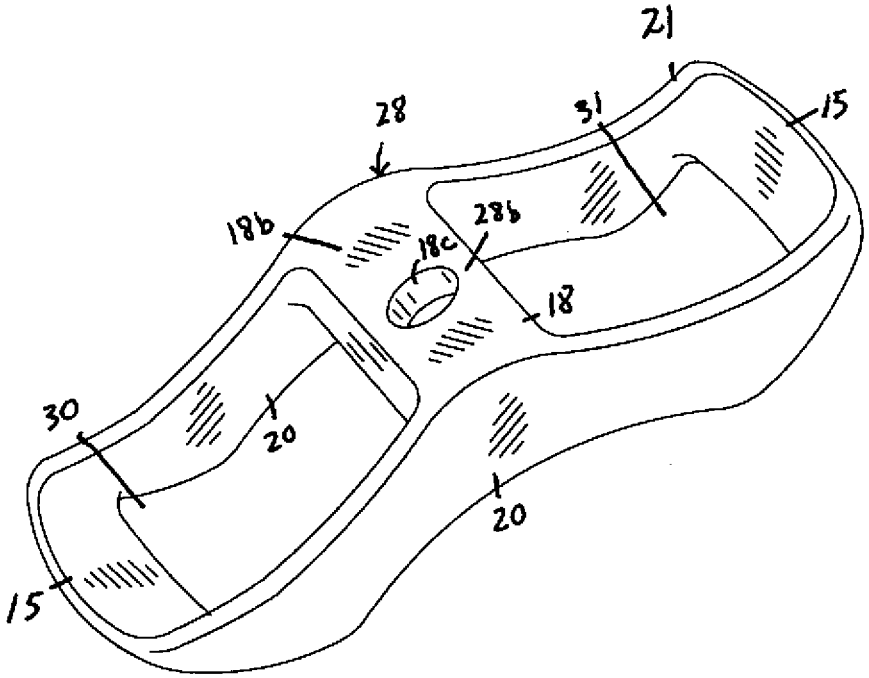
FIG. 4 is a perspective view of the outward side of the connecting member illustrated in FIG. 3.
Figure 5:
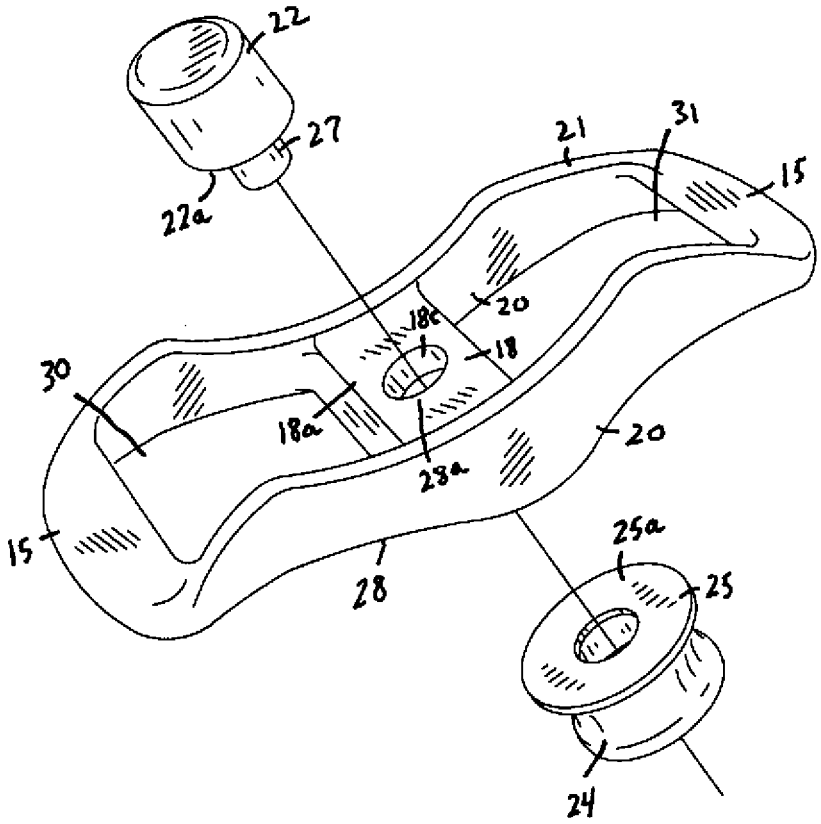
FIGS. 5 and 5A are exploded views of the connecting member and unattached fastener.
Figure 5A:
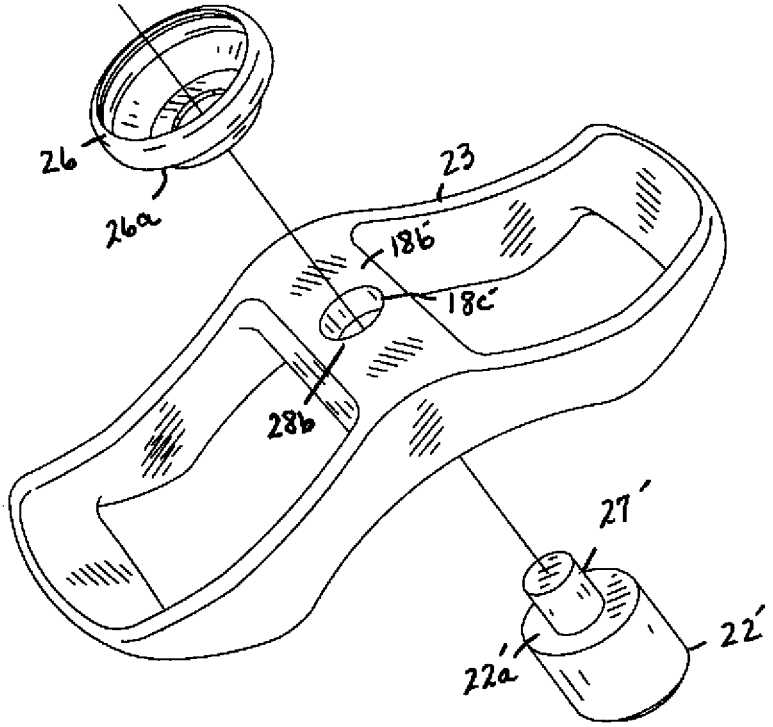
Figure 6:
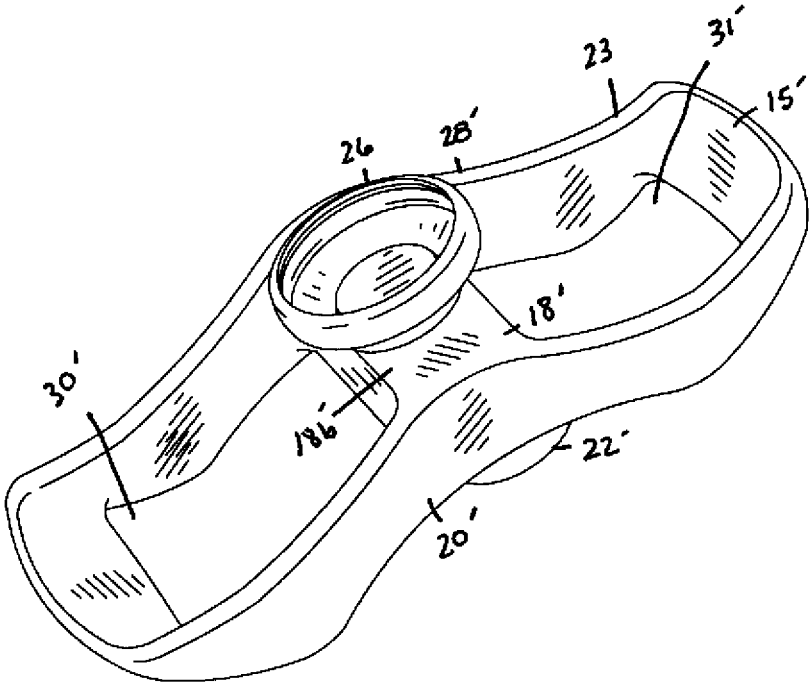
FIG. 6 is a perspective view of the connecting member and female half fastener.
Figure 7:
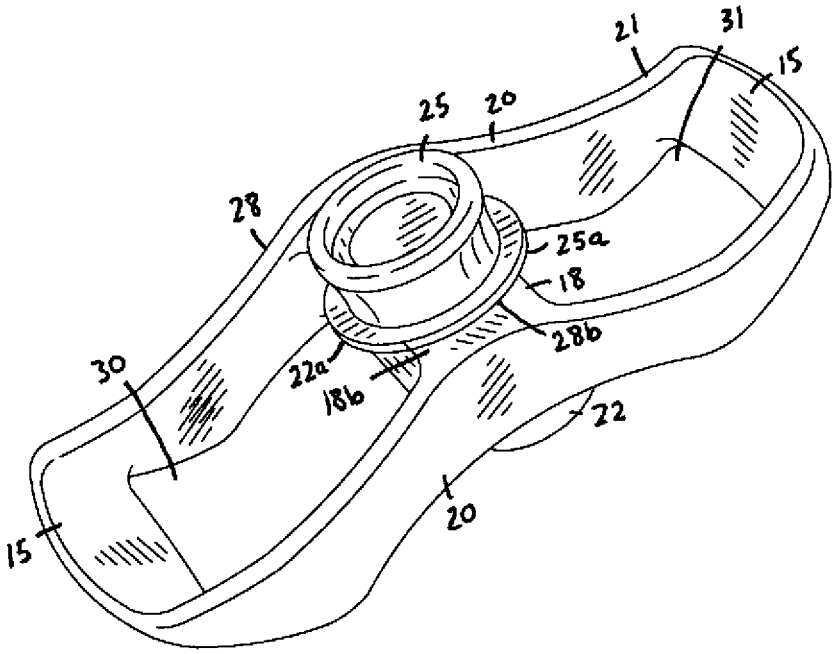
FIG. 7 is a perspective view of the connecting member and male half fastener.
Figure 8:
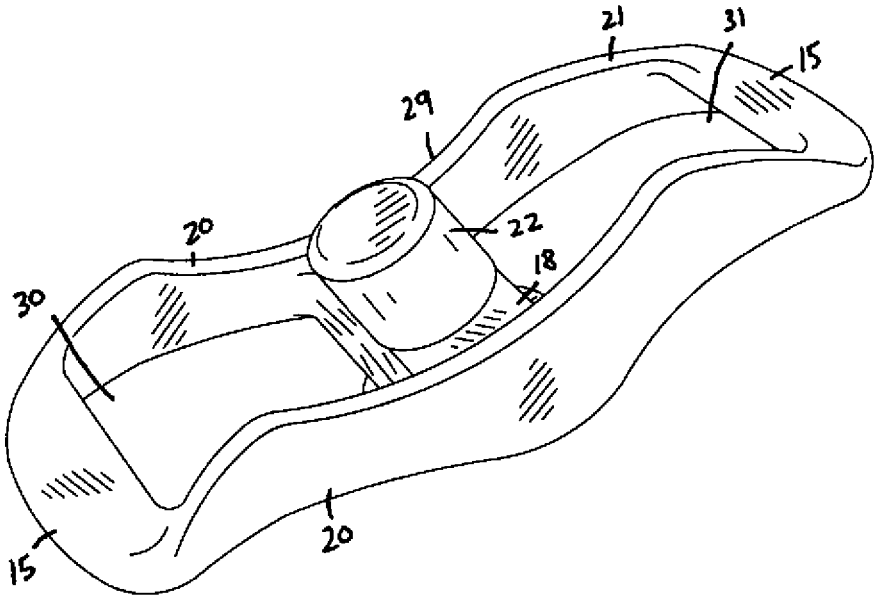
FIG. 8 is a perspective view of the inward side of the connecting member further illustrating the raised member.

The fastener is preferably a snap fastener having two halves, a male half 25 that is attached to the second side 18*b* of the connecting member 21, and a female half 26 that is attached to the second side 18*b*' of the connecting member 23. A rod portion 27 (see FIGS. 5 and 5A) of the raised member 22 passes through the aperture 18*c* and connects with the male half 25 on the connecting member 21, and connects with the female half 26 on the connecting member 23. The raised member 22 further defines a planar surface 22*a* that abuts a flat surface 28*a* of the center bar's 18 first side 18*a* (outward side 29). Similarly, the fastener halves 25, 26, each define a planar surface 25*a*, 26*a*, respectively, that abuts a flat surface 28*b* of the center bar's 18 second side 18*b* (inward side 28).

The male half 25 includes a groove 24 which snaps in place when pressed into the female half 26 such that in application the outward sides 29, 29' of each connecting member 21, 23 are releasably attached. An acceptable alternative to the snap fasteners described may be a hook fastener, a press stub, or other similar fastener.

As earlier described, the split reins include first and second reins 5*a*, 5*b* that extend from the end rings 6 to the rider. In application, the connector device 10 is used with split reins. Connecting member 21 having the male fastener half 25 is attached with the first rein 5*a*, and connecting member 23 having the female fastener half 26 is attached with the second rein 5*b*. When the rider is not riding, such as when the rider ties the horse to the post, rather than applying the known method of tying a knot in the first and second reins and resting the knotted reins on the horse approximately past where the hand grip would be, the rider can simply releasably attach the outward side 29 (having the male fastener) of the connecting member 21 on the first rein to the outward side 29' (having the female fastener) of the connecting member 23 on the second rein by attaching male and female halves 25, 26, in order to maintain both reins together on the horse.

In application, an end of one of the split reins guided beneath the end bar 15 adjacent the first spacing 30 and is upwardly passed through the first spacing 30 and positioned over the raised member 22 and downwardly passed through the second spacing 31. Each connecting member 21, 23 can be slidably positioned along the length of the reins for application.

As illustrated, the raised member 22 defines a height H (see FIGS. 1 and 2) that upwardly extends above the pair of spaced end bars 15. The Inventor has found this embodiment critical in order to maintain the selected position of the connector 10 along the length of the reins during application. In testing, the Inventor found that when the height of the raised member was equal to or less than the height of the end bars, the results were undesirable. In such case, the connector would tend to slip or re-adjust during application.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A connector device adapted for use with split reins comprising:

first and second connecting members, each of said connecting members comprising a pair of spaced end bars and a center bar joined together by a pair of side bars, said pair of side bars having a semi-U shaped configuration that define an inward side and an outward side, said center bar having a central aperture, and wherein said pair of spaced end bars and center bar define a first spacing and a second spacing, and wherein said pair of side bars are parallel to one another, and pair of end bars and center bar are parallel to one another and perpendicular to said pair of side bars, wherein said pair of side bars define a length and said end bars define a width, and where said length is greater than said width, each of said first and second connecting members include a fastener such that a male fastener half is attached to a second side of the first connecting member, and a female fastener half is attached to a second side of the second connecting member, and wherein a rod portion of a raised member is configured to pass through the aperture of each of the connecting members and connect with the male fastener half on the first connecting member and connect with the female fastener half on the second connecting member, said raised member further defines a planar surface that abuts a flat surface of the center bar's first side, and each of said male and female fastener halves define a planar surface that abuts a flat surface of the center bar's second side, and wherein said male fastener half defines a groove configured to snap in place when pressed into the female fastener half such that in application the outward sides of each of said first and second connecting member are releasably attached.

2. A connector device adapted for use with split reins comprising:

first and second connecting members, each of said connecting members comprising a pair of spaced end bars and a center bar joined together by a pair of side bars, said pair of side bars having a semi-U shaped configuration that define an inward side and an outward side, said center bar having a central aperture, and wherein said pair of spaced end bars and center bar define a first spacing and a second spacing, and wherein said pair of side bars are parallel to one another, and pair of end bars and center bar are parallel to one another and perpendicular to said pair of side bars, wherein said pair of side bars define a length and said end bars define a width, and where said length is greater than said width, said center bar including a raised member disposed on the inward side of each of said first and second connecting members, and said center bar further including a male fastener half disposed on the outward side of said first connecting member, and a female fastener half disposed on the outward side of said second connecting member.

3. The connector device of claim 2, wherein a rod portion of said raised member is configured to pass through the center bar's aperture of each of said first and second connecting members and connect with the male fastener half on the first connecting member and connect with the female fastener half on the second connecting member.

4. The connector device of claim 3, wherein said raised member further defines a planar surface that abuts a flat surface of the center bar's first side, and each of said male and female fastener halves define a planar surface that abuts a flat surface of the center bar's second side.

5. The connector device of claim 4, wherein said male fastener half defines a groove configured to snap in place when pressed into the female fastener half such that in application the outward sides of each of said first and second connecting member are releasably attached.

6. A method of adapting a connector device to the practice of riding horseback using split reins, the method comprising the steps of:

separating said connector device into a first connecting member and a second connecting member, each of said connecting members comprising a pair of spaced end bars and a center bar joined together by a pair of side bars, said pair of side bars having a semi-U shaped configuration that define an inward side and an outward side, said center bar having a central aperture, and wherein said pair of spaced end bars and center bar define a first spacing and a second spacing, and wherein said pair of side bars are parallel to one another, and pair of end bars and center bar are parallel to one another and perpendicular to said pair of side bars, said center bar including a raised member disposed on the inward side of each of said first and second connecting members, and said center bar further including a male fastener half disposed on the outward side of said first connecting member, and a female fastener half disposed on the outward side of said second connecting member, and wherein said male fastener half defines a groove configured to snap in place when pressed into the female fastener half, directing an end of a first split reins through the first spacing of the first connecting member such that the first split rein passes over the raised member, directing said end of said first split rein through the second spacing of the first connecting member, directing an end of a second split reins through the first spacing of the second connecting member such that the second split rein passes over the raised member, directing said end of said second rein through the second spacing of the second connecting member, connecting the male fastener half to the female fastener half such that the outward sides of each of said first and second connecting members are releasably attached.

7. The method of claim 6, including the step of slidingly positioning each connecting member along the length of the split reins.

8. The method of claim 7, wherein said pair of side bars define a length and said end bars define a width, and where said length is greater than said width.

9. The method of claim 8, wherein a rod portion of said raised member is configured to pass through the center bar's aperture of each of said first and second connecting members and connect with the male fastener half on the first connecting member and connect with the female fastener half on the second connecting member.

10. The method of claim 9, wherein said raised member further defines a planar surface that abuts a flat surface of the center bar's first side, and each of said male and female fastener halves define a planar surface that abuts a flat surface of the center bar's second side.

* * * * *